US005725175A

United States Patent [19]

Thundathil

[11] Patent Number: 5,725,175

[45] Date of Patent: Mar. 10, 1998

[54] SINGLE TENSION ADJUSTMENT FOR DUAL WIRE ROLLS

[75] Inventor: Francis Thundathil, Menasha, Wis.

[73] Assignee: The Miller Group, Ltd., Appleton, Wis.

[21] Appl. No.: 592,621

[22] Filed: Jan. 26, 1996

Related U.S. Application Data

[63] Continuation of Ser. No. 262,467, Jun. 20, 1994, abandoned.

[51] Int. Cl.[6] ..... B65H 59/02

[52] U.S. Cl. ..... 242/423.2; 242/594.3; 242/597.6

[58] Field of Search ..... 242/396.9, 423.1, 242/423.2, 594.3, 597.6, 397, 575.3

[56] References Cited

U.S. PATENT DOCUMENTS

| | | | |
|---|---|---|---|
| 1,836,969 | 12/1931 | Hick | 242/594.3 X |
| 1,944,582 | 1/1934 | Snyder | 242/594.3 X |
| 1,950,492 | 3/1934 | Holmes, Jr. | 242/575.3 |
| 2,574,216 | 11/1951 | Lindgren | 242/396.9 |
| 2,965,327 | 12/1960 | Blary | 242/594.3 X |
| 3,127,125 | 3/1964 | Jilbert | 242/594.3 X |
| 3,171,610 | 3/1965 | Hoch | 242/423.1 X |
| 3,338,536 | 8/1967 | Hull et al. | 242/397 X |
| 3,907,229 | 9/1975 | Iannucci et al. | 242/423.2 X |
| 4,190,211 | 2/1980 | Janzen | 242/423.1 |
| 4,375,279 | 3/1983 | Koch | 242/594.3 X |
| 4,625,931 | 12/1986 | Tamura et al. | 242/423.1 |
| 4,885,453 | 12/1989 | Martin | 242/423.1 X |
| 5,322,236 | 6/1994 | Smith | 242/156 X |

*Primary Examiner*—Daniel P. Stodola
*Assistant Examiner*—William A. Rivera
*Attorney, Agent, or Firm*—Foley & Lardner

[57] ABSTRACT

A spool support assembly for supporting the wire spools for a thermal spray gun, the assembly including a stand having a pair of axially aligned keyed openings, a bolt aligned in the openings and having a keyway matingly engaging the keyed opening, a hub mounted on the bolt on each side of the stand for supporting the wire spools, a spring mounted on the bolt on the outer end of the hubs and a nut provided on one end of the bolt for simultaneously adjusting the compressive force of the springs to maintain the same tension on the wires between the spools and the thermal spray gun.

5 Claims, 2 Drawing Sheets

SINGLE TENSION ADJUSTMENT FOR DUAL WIRE ROLLS

This is a continuation of application Ser. No. 08/262,467 filed Jun. 20, 1994, abandoned.

FIELD OF THE INVENTION

The present invention relates to a thermal spray process known as wire arc spraying and more particularly to a spool support for the wire that is fed to the gun head.

BACKGROUND OF THE INVENTION

Wire arc spraying guns of the type contemplated herein include a pair of drive rolls for feeding the wire through the spray gun. Wire spool supports presently used for wire arc spraying generally include a fixed bolt which is welded in the center to a supporting frame or stand. The bolt is threaded on both ends. A wire spool is mounted on each end of the shaft and retained thereon by means of a nut and a compression spring, each of which can be adjusted independently on the threaded ends of the bolts. This often creates a difference in tension on each wire which can result in an unequal wire feed to the spray feeder by the drive rolls. More particularly, one of the undesirable effects of unequal wire feeding is that some wire can be stretched and become undersized. Undersize wire will not feed through the drive rolls thus preventing arc spraying.

SUMMARY OF THE PRESENT INVENTION

In accordance with the present invention a standard bolt having a keyway machined along the major length of the bolt is mounted for axial movement in a frame or stand. Tabs are provided in the frame for engaging the keyway to prevent rotation of the bolt. The bolt is thus free to move axially in the frame or stand. Hubs are provided on the bolt on each side of the frame with a wire spool mounted on each of the hubs. Springs are provided on each end of the bolt to bias the hubs inwardly toward the frame. The wire spools are mounted on hubs which can be adjusted simultaneously by a single nut provided at one end of the shaft. In this regard axial movement of the shaft will result in equal tension on the wire spools, thus providing consistent feed of the wire through the drive rolls to the sprayer.

One of the primary advantages of the invention is the ability to simultaneously adjust the tension of the wires by adjusting a nut mounted on one end of the bolt.

A further advantage of the invention is to positively connect both spools to the hubs so that the tension in the wires will remain substantially constant.

A principal object of the invention is to provide a dual wire spool for maintaining the same tension in the wires as they are drawn into a thermal spray gun.

Other principal features and advantages of the invention will become apparent to those skilled in the art upon review of the following drawings, the detailed description and the appended claims.

Figure 1:
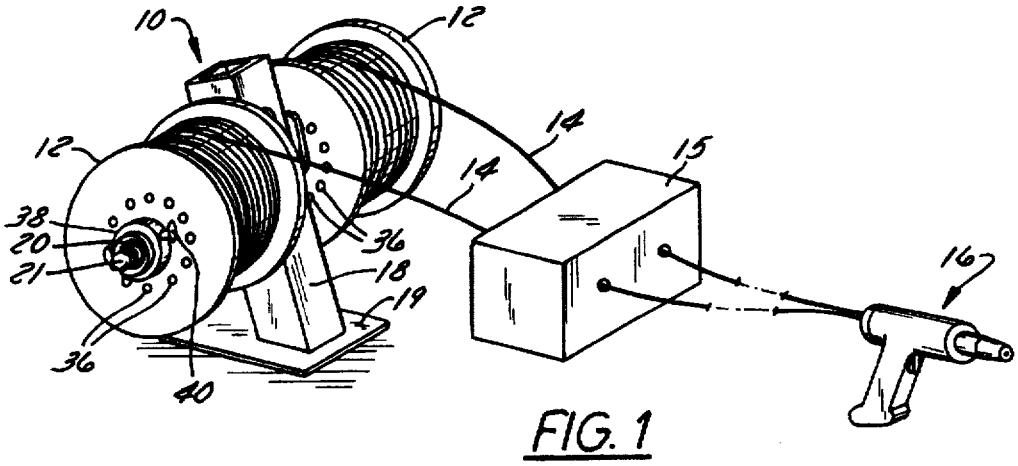
FIG. 1 is a perspective view of a wire arc spraying assembly.
Figure 5:
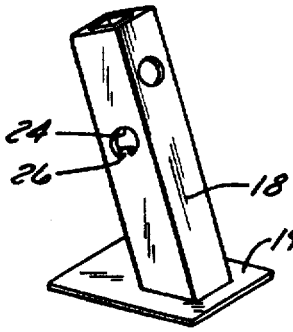
FIG. 5 is a perspective view of the stand showing the tab 26 in opening 24.
Figure 4:
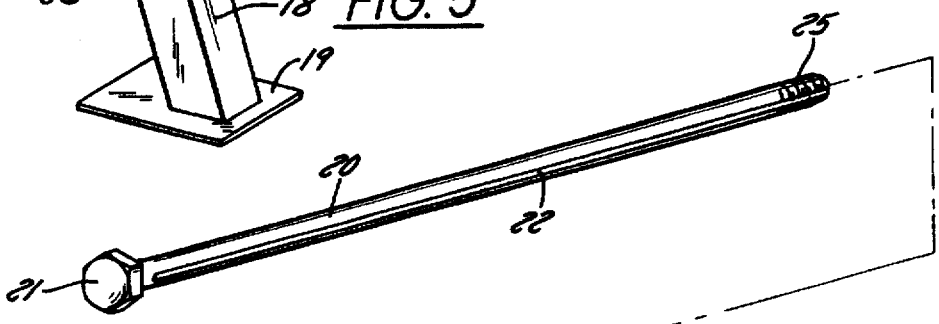
FIG. 4 is an exploded view of the bolt assembly for the spool support.
Figure 4:
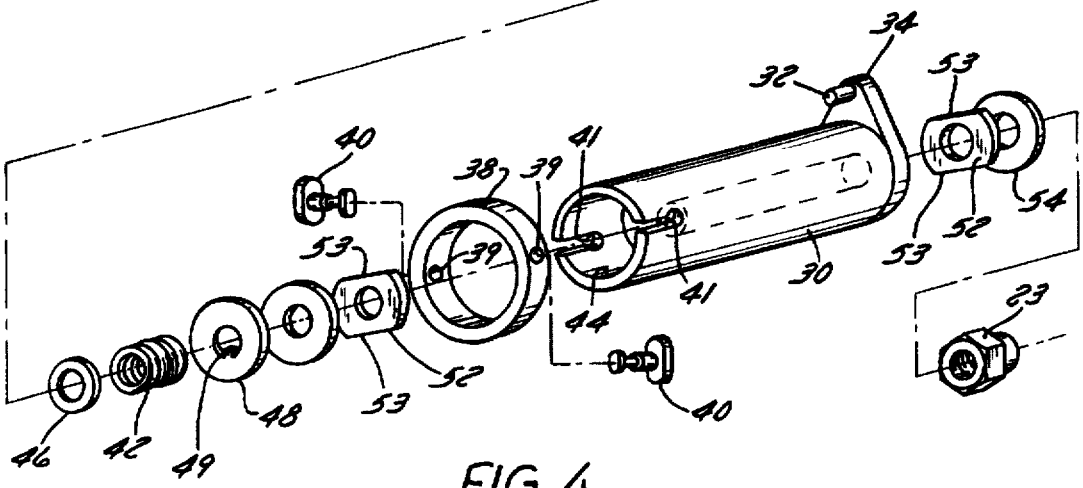
Figure 2:
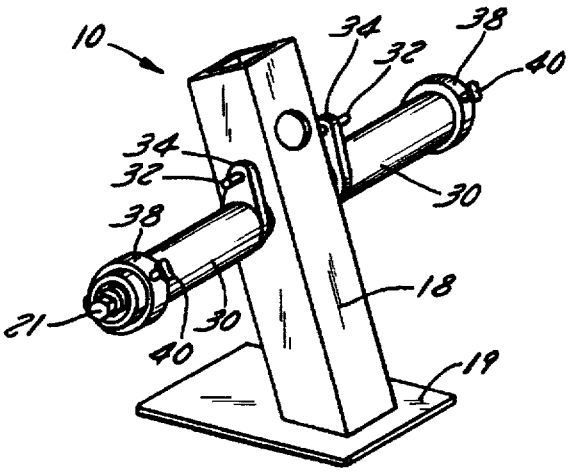
FIG. 2 is a perspective view of the wire holder.
Figure 3:
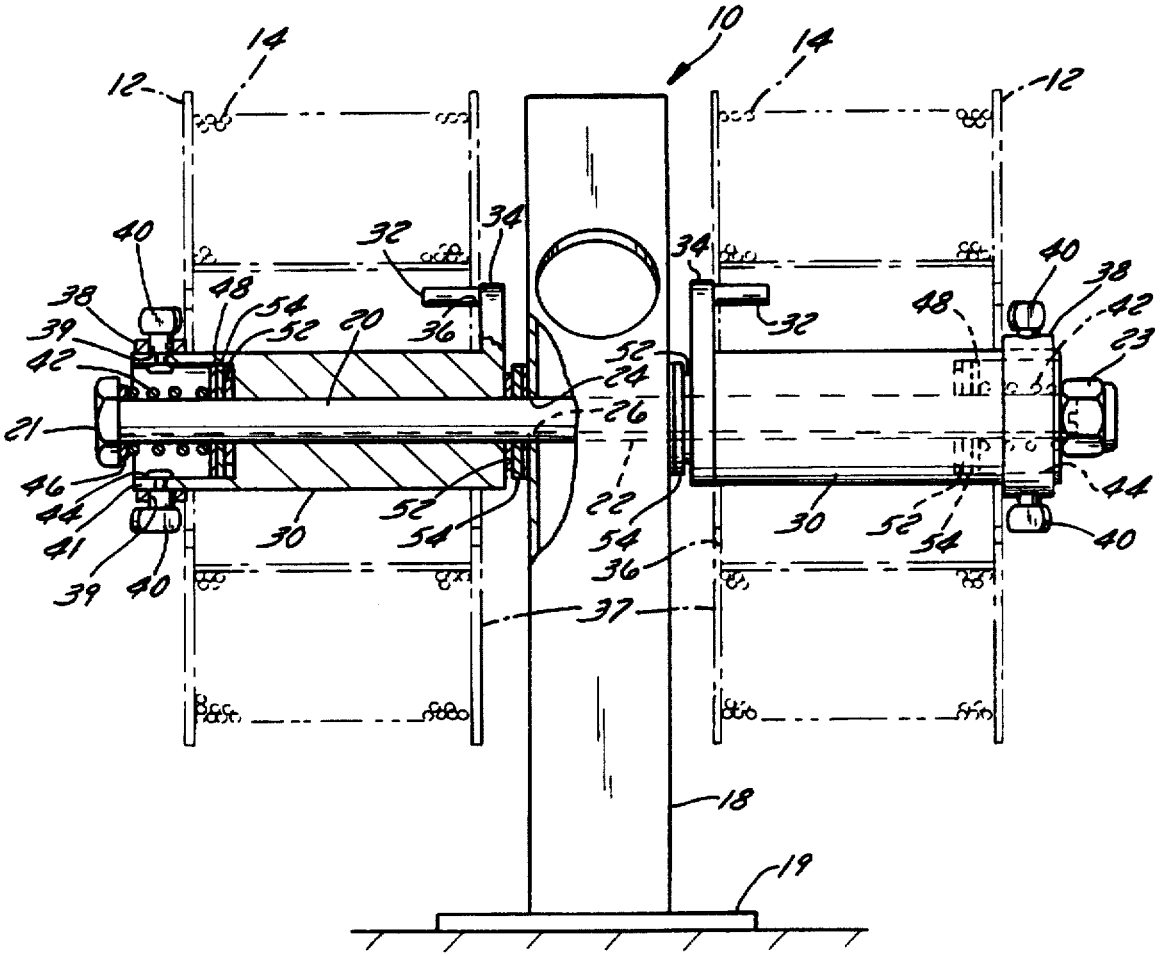
FIG. 3 is a front elevation view of the dual wire support.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The spool support assembly 10 as shown in FIG. 1 is used in a thermal spray process more commonly known as a wire arc spraying. A pair of wire spools 12 are supported on the support assembly 10 for feeding wire 14 to the drive rolls 15 provided on the gun head 16.

The spool support assembly 10 generally includes a stand 18 mounted on a base plate 19 for supporting a bolt 20 in a generally horizontal relation to the stand 18. The bolt 20 generally includes a head 21 at one end, a keyway 22 extending generally three quarters of the length of the bolt 20 and a nut 23 on the threaded end 25 of the bolt 20. The stand 18 includes a pair of openings 24 each of which includes a tab 26 aligned with the keyway 22. The bolt 20 thereby being prevented from rotating with respect to the stand 18 but capable of axial movement with respect to the stand 18.

A hub or tube 30 is mounted on bolt 20 on each side of the stand 18 for supporting the wire spools 12. The spools are secured to the hubs 30 by pin 32 mounted on the side of a radial flange 34 located on one end of each hub 30 for matingly engaging one of the holes 36 provided in the side walls 37 of the spools 12. The spools 12 are retained on the hubs 30 by means of sliding retaining rings 38 mounted on the end of hubs 30. Each ring 38 includes a hole 39 on each side which is aligned with slots 41 in the end of the hub 30. A spring loaded plunger 40 is aligned with the hole 39 and the slot 41 for engaging the ends of hubs 30. The spring loaded plunger 40 is provided for securing the retaining ring 38 to the hub 30.

Means are provided on each end of the hubs 30 for controlling the rotating friction and thereby the tension of wires 14 as they are drawn into the drive rolls 15 for the gun head 16. The rotating friction means is in the form of a compression spring 42 mounted in a recess 44 on the outer end of each of the hubs 30. A washer 46 is provided on each end of the bolt 20 to maintain the springs 42 in the recess 44. A keyed washer 48 having tab 49 is provided on the inner end of each spring 42 with the tab 49 aligned with the keyway 22 to eliminate any rotary forces on the spring 42.

Means are also provided for controlling the frictional forces on the end of the hubs 30. Such means is in the form of multiple washers; metal keyed washer 48, fiber (or brake) friction washer 54 and metal washer 52 having flats 53. The inner washer 52 is inserted into the ends of the hubs 30 and rotates with hub 30. The intermediate fiber friction washers 54 provide sliding friction which is adjustable by repositioning nut 23 to control the tension on the wires 14 which is thereby accomplished.

In this regard, the tension on the wires 14 is simultaneously controlled by adjusting the nut 23 on the end of the bolt 20. Since the bolt 22 is not welded to the stand 18 the horizontal movement of the bolt will simultaneously adjust the force of the compression springs in both hubs 30 providing an even and consistent tension in the wires between the wire spools 12 and the drive rolls 15.

Thus, it should be apparent that there has been provided in accordance with the present invention a single tension adjustment for dual wire rolls that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A stand for supporting a pair of spools, from which wire is simultaneously withdrawn and fed into a thermal spray gun with the same tension said stand having a keyed opening on each side, a bolt having a keyway aligned in the keyed openings in the stand, a hub mounted on the bolt on each side of the stand, one of the wire spools adapted to be mounted on each of the hubs, means mounted on each of the hubs for connecting said spools to said hubs so that said spools rotate in conjunction with one another, a fiber friction washer mounted on the bolt on each end of each hub, a keyed washer mounted on the bolt in alignment with the keyway, a spring mounted on each end of the bolt in abutting engagement with each of the keyed washers and a nut provided on one end of the bolt wherein adjustment of the nut simultaneously adjusts the compressive force of the springs on each of the fiber friction washers to maintain the same tension on each of the wires being drawn into the thermal spray gun.

2. The spool support according to claim 1 wherein each of said hubs includes a recess at one end for housing said springs.

3. A wire spool support assembly for maintaining the same tension in each of a pair of wires being drawn into a pair of drive rolls for a thermal spray gun, said assembly comprising a stand having a pair of axially aligned keyed openings, a bolt having a head at one end, a threaded section at the other end and a keyway for aligning the bolt in the keyed openings, a hub mounted on said bolt on each side of the stand for supporting the wire spools, means mounted on each of the hubs for connecting said spools to said hubs so that said spool rotate in conjunction with one another, a fiber friction washer mounted on the bolt on the outer end of each of said hubs, a compression spring mounted on each end of the bolt in alignment with each of the fiber friction washers, and means for simultaneously adjusting the frictional force of the fiber friction washers on each end of said hubs, the adjusting means including a nut mounted on the threaded end of the bolt for simultaneously adjusting the compressive force of the springs on the fiber friction washers to maintain the same tension in the wires being drawn into the drive rolls.

4. The support according to claim 3 wherein each of said hubs includes a recess at one end for housing the fiber washer and the compression springs.

5. The support assembly according to claim 3 including a retainer ring mounted on each hub for holding the spools on said hubs.

* * * * *